United States Patent [19]

Leclerc et al.

[11] 4,300,686

[45] Nov. 17, 1981

[54] STACKABLE NESTABLE CONTAINER

[76] Inventors: Roland Leclerc, 5950 Normand St., St. Hubert, Canada, Q3Y 1M3; Owen Larkin, 188 Leeds Ave., Beaconsfield, Canada, H9W 2H5

[21] Appl. No.: 206,853

[22] Filed: Nov. 14, 1980

[51] Int. Cl.[3] ..... B65D 21/06

[52] U.S. Cl. ..... 206/506; 206/505; 206/513; 220/19

[58] Field of Search ..... 206/505, 506, 513; 220/19

[56] References Cited

U.S. PATENT DOCUMENTS

| | | | |
|---|---|---|---|
| 2,803,369 | 8/1957 | Fleetwood | 220/19 |
| 2,970,714 | 2/1961 | Glezen | 206/505 |
| 3,245,572 | 4/1966 | Mashy | 220/19 |
| 3,409,163 | 11/1968 | Lockwood | 206/505 |
| 3,752,352 | 8/1973 | Senecal | 206/513 |

FOREIGN PATENT DOCUMENTS

| | | | |
|---|---|---|---|
| 1187675 | 4/1970 | United Kingdom | 206/506 |

*Primary Examiner*—George E. Lowrance

[57] ABSTRACT

A wire member container is disclosed, comprising a generally rectangular and planar base, opposite side walls and opposite ends. The base is provided with an inner transverse end member at each end and an outer transverse end member which is spaced slightly above the inner end member. The base is formed of a plurality of parallel spaced-apart ribs, whose ends are secured horizontally to the inner end member at each end, and a plurality of parallel, spaced-apart cross-members. The ends of the latter turn upwardly on each side to form the side wall ribs. These are rigidly interconnected at their upper portions by a pair of vertically spaced-apart horizontal rib members. The lower one of these rib members is bent upwardly at its central portion to form a handle on each side of the container. Means are provided to both stack and nest several containers together.

3 Claims, 3 Drawing Figures

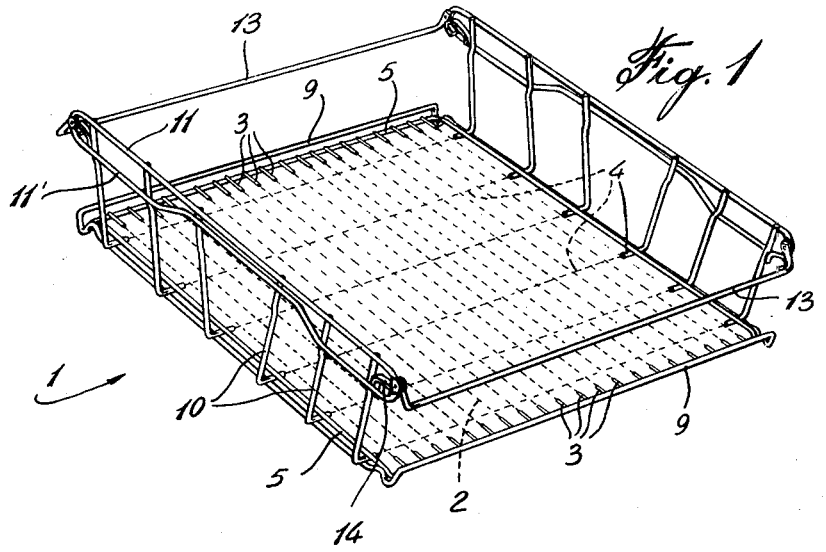
Fig. 1
Fig. 2
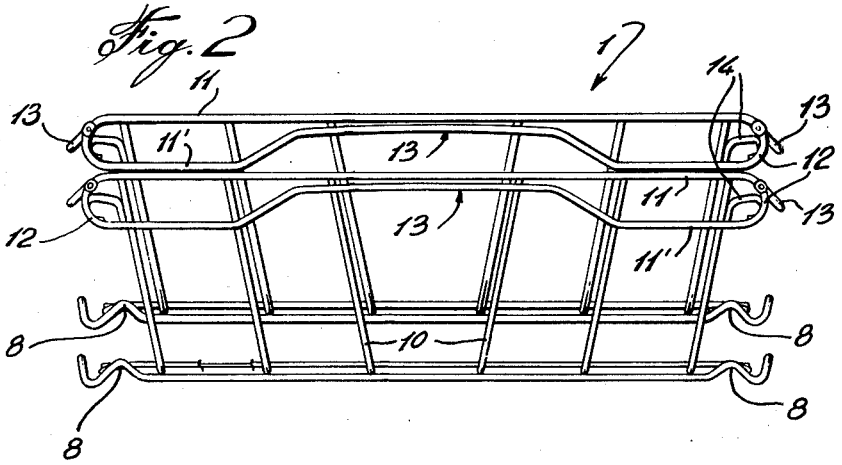
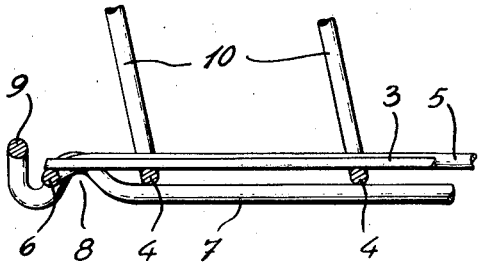
Fig. 3

STACKABLE NESTABLE CONTAINER

FIELD OF THE INVENTION

The present invention relates generally to containers and, more specifically, to a novel wire-type container which is both stackable and nestable.

BACKGROUND OF THE INVENTION

The prior art is replete with containers of the wire-type which are both stacklable and nestable. (The term stackable as referred to herein means the placing of one container on top of another without obstructing the payload-carrying space of either container. The term nestable means the placing of one container inside another, so that the payload-carrying space of the other container is obstructed). The container disclosed herein is an improvement over the container described in Canadian Pat. No. 945,487 dated Apr. 16, 1974, in the name of Yvan Senecal, and is also an open-ended basket type which has movable parts adapted to secure several such containers in stacked relationship; the Senecal and other prior art containers of the above type have had a twofold disadvantage. Firstly, only a limited number of containers could be picked up manually or by machine when nested together due to the particular construction of the sides of each container. Secondly, the transverse end members have till now been spaced above the floor of the basket defined by a plurality of transverse, parallel and spaced-apart cross-members and a plurality of longitudinal, parallel, spaced-apart ribs. These ribs are curved upwardly at their opposite ends and welded to the transverse end member at each end of the container. It frequently happened that the curved end portions of the ribs became detached from the transverse end members through use. This is undesirable because the resultant sharp ends tend to puncture or rip the wrapping of an article or merchandise placed in the container.

OBJECTS OF THE INVENTION

Accordingly, it is a prime object of the present invention to provide a stackable, nestable container which will remain intact over a long period of continued use.

It is another object of the present invention to provide a stackable nestable container having side walls specially constructed to allow a plurality of such containers in nested relationship to be easily carried by hand or by machine.

It is yet another object of the present invention to provide a stackable nestable container which is lightweight and economical to manufacture.

SUMMARY OF THE INVENTION

The above and other objects and advantages of the present invention are realized in accordance with a preferred embodiment comprising a basket-shaped container open at both ends, made of wire-members and having a base and two parallel spaced-apart upstanding side walls.

The base is substantially planar and consists of a plurality of spaced-apart, parallel, longitudinal ribs and a plurality of parallel, spaced-apart, transverse cross-members.

A rail is provided on each side and is formed at its opposite ends with a downwardly-opening arcuate indentation and then curves upwardly and inwardly, becoming a first transverse end member. Located inwardly and below this first transverse end member, is a second transverse end member to which the ends of all the parallel ribs are secured. The ends of these ribs are therefore protected by the first transverse end member. There is, therefore, much less of a possibility that the ends of the ribs will become separated from the second transverse end member and, thus, constitute sharp points which might puncture or rip articles of merchandise and/or their wrapping.

In a conventional manner, the transverse cross-members have upturned opposite ends rising upwardly and forming the horizontally spaced-apart side wall ribs of the container. The side wall ribs are inclined towards the respective ends of the container, starting from the central transverse vertical plane, to permit the nesting of one container within another.

In a conventional manner, the top portions of these side wall ribs on each side of the container are rigidly interconnected by a pair of vertically spaced-apart and lengthwise-extending horizontal rib members. Each outer end of these horizontal rib members merges to form a loop. According to a secondary feature of the present invention, the lower horizontal rib member is bent upwardly in its central portion, so that it closely underlies the upper horizontal rib member forming a reinforced handle section by means of which a plurality of containers nested in relationship may be picked up manually or by machine and carried.

In a conventional manner, each loop has affixed to it a pivotable transverse bail. The latter may be pivoted outwardly to an inoperative position for nesting on inwardly, wherein each bail engages the arcuate indentations on each side and at each end of the container, whereby a plurality of containers may be positioned in stacked relationship.

The above will be more clearly understood by having referral to the preferred embodiment of the invention, illustrated by way of the accompanying drawings, in which:

BRIEF DESCRIPTION OF THE DRAWINGS

FIG. 1 is a perspective view of the container according to the present invention;

FIG. 2 is a side elevation of two such containers in nested relationship, showing the bails in inoperative position; and FIG. 3 is a cross-sectional side elevation of one of the corners of the container.

Like numerals refer to like elements throughout the drawings.

DETAILED DESCRIPTION OF THE INVENTION

The container 1 comprises a rectangular base 2, which is generally planar and is formed of a plurality of parallel spaced-apart longitudinal ribs 3 and a plurality of parallel and spaced-apart cross-members 4. Ribs 3 and underlying cross-members 4 are welded together at their junctures.

Each side of the container is provided with an inner side rail 5 which overlies and is welded to cross-members 4 and whose opposite ends are bent downwardly, then turned inwardly at right angles forming an inner transverse end member 6 at each end of container 1. The ends of all the parallel ribs 3 are welded, or otherwise rigidly secured, to end members 6 on top of the latter. End members 6 are level with cross-members 4 and, consequently, ribs 3 are straight throughout their length.

Each side of the container is also provided with an outer side rail 7 which underlies and is welded to cross-members 4. Rail 7 is slightly thicker in diameter than inner side rail 5. The opposite ends of the two side rails 7 are formed firstly with a downwardly-opening arcuate indentation 8 and then rise upwardly and turn inwardly forming an outer transverse end member 9. The latter is spaced outwardly and slightly above inner end member 6, thus forming a barrier to prevent merchandise from sliding out of container 1.

The opposite ends of each cross-member 4 are upturned forming side wall ribs 10. The preferred embodiment as illustrated in the figures has six such side ribs 10 on each side, but it is to be understood that there could be a varying number of ribs 10.

The three ribs 10 of the left half of container 1, as shown in FIG. 2, are inclined outwardly and are parallel as are the three ribs 10 of the right half of container 1, which are inclined in the opposite direction. Thus, the three ribs 10 on the left and right half of container 1 converge downwardly.

The top portions of side ribs 10 on each side of container 1 are rigidly interconnected by a pair of integrally formed, vertically spaced-apart horizontal rib members, namely an upper rib 11 and a lower rib 11', each extending in the lengthwise direction on the outside of ribs 10 and welded thereto.

The opposite outer ends of rib members 11 and 11' merge to form a loop 12. The central portion 13 of the lower rib member 11' is bent upwardly so that it closely underlies the upper rib 11, together forming a reinforced handle for carrying two or more containers in nested relationship.

It will be appreciated that, when one container is nested within another, the lower rib 11' of the nested container abuts against the upper rib 11 of the lower container.

Conventional means are also provided to stack several containers together. These means consist of a pivotable transverse bail 13 movably secured at each of its ends to the spaced-apart loops 12 of each side of container 1. Each bail 13 is adapted to pivot between an outer inoperative position, as shown in FIGS. 1 and 2, and inner or operative position. In both limit positions, bail 13 abuts stops 14 secured to the inside of loops 13 and to the endmost ribs 10. In the operative position, bails 13 of the lower container will engage the corresponding arcuate indentations 8 of the upper container. In this way, a plurality of containers 1 may be easily stacked together.

It is to be noted that containers may be stacked or nested together, even if rotated at 180 degrees.

It should also be noted that the raised central portion 13 makes it less tiresome to grasp the handles while wearing gloves than in the Senecal Patent, wherein the hand has to take a grip around the two vertically-spaced horizontal rib members while carrying a container.

It is to be understood that modifications may be made to the preferred embodiment without departing from the spirit or scope of the present invention. In particular, the configuration of the abovedescribed reinforced handle portion may be varied.

What we claim is:

1. A container adapted to be stacked and nested with other like containers, comprising a generally planar base; a pair of opposite side walls, each upwardly and outwardly inclined rising from said base, and wherein their upper portions are vertically offset, said container being open at both ends; said base being formed of a plurality of longitudinally-extending spaced-apart and parallel rib members and a plurality of spaced-apart parallel cross-members secured to the underside of said rib member intermediate the ends thereof; further comprising on each side of said base an inner side rail turning inwardly and slightly downwardly at its opposite ends to form an inner transverse end member at each end of said base, said inner side rails and said inner transverse end members defining a continuous inner frame, said ribs being straight throughout their length and secured at their ends to the top side of each corresponding said inner end member; an outer side rail having opposite ends formed with a downwardly-opening arcuate indentation and curving upwardly and inwardly to form an outer transverse end member disposed substantially parallel to, and at a higher level, than said inner transverse end member and at a higher level than, and outwardly spaced from the ends of said longitudinal rib member, said outer side rails and said outer transverse end members defining a continuous outer frame; said inner side rails being spaced slightly above said outer side rails by a distance equal to the thickness of one said cross-member, a pair of pivotable transverse bails movably secured at each end of said side walls adjacent the upper end portions thereof, wherein said bails can be moved from an outer inoperative position for nesting an upper-like container within said container to an inner operative position for stacking said upper container with said bails engaging the indentations of said upper container; each said side wall being provided with a central handle portion.

2. A container as defined in claim 1, wherein said cross-members turn upwardly adjacent the sides of said base defining a plurality of side ribs; said side ribs inclined lengthwise of said container whereby one container may be nested in another, and wherein said side ribs are rigidly interconnected at their upper portions by a pair of vertically spaced-apart horizontal rib members, namely an upper and a lower rib member, said upper and said lower rib members secured to the outside of said side ribs, the upper ribs of a lower container directly abutting the lower ribs of an upper container nested within the lower container.

3. A container as defined in claim 1 or 2, wherein said longitudinal rib members are of smaller diameter wire than said inner side rails and the latter overlie said cross-members and are secured thereto, and wherein said inner transverse end members are level with said cross-members.

* * * * *